US008979010B2

(12) United States Patent
Doppstadt et al.

(10) Patent No.: US 8,979,010 B2
(45) Date of Patent: Mar. 17, 2015

(54) COMB TOOTH HOLDER

(75) Inventors: Johann Doppstadt, Velbert (DE); Horst Berger, Calbe (DE)

(73) Assignee: Doppstadt Familienholding GmbH, Velbert (DE)

( * ) Notice: Subject to any disclaimer, the term of this patent is extended or adjusted under 35 U.S.C. 154(b) by 161 days.

(21) Appl. No.: 13/643,403

(22) PCT Filed: Apr. 20, 2011

(86) PCT No.: PCT/EP2011/002001

§ 371 (c)(1),
(2), (4) Date: Oct. 25, 2012

(87) PCT Pub. No.: WO2011/134616

PCT Pub. Date: Nov. 3, 2011

(65) Prior Publication Data

US 2013/0037642 A1 Feb. 14, 2013

(30) Foreign Application Priority Data

Apr. 25, 2010 (DE) ..... 20 2010 006 078 U

(51) Int. Cl.
*B02C 18/18* (2006.01)
*B02C 18/14* (2006.01)

(52) U.S. Cl.
CPC ..... *B02C 18/18* (2013.01); *B02C 18/145* (2013.01); *B02C 2018/188* (2013.01)
USPC ..... 241/294

(58) Field of Classification Search
USPC ..... 241/294
See application file for complete search history.

(56) References Cited

U.S. PATENT DOCUMENTS

| | | | | |
|---|---|---|---|---|
| 4,946,109 | A | 8/1990 | Lewis | |
| 7,938,350 | B2 | 5/2011 | Doppstadt | |
| 2007/0194161 | A1 * | 8/2007 | Doppstadt et al. | 241/294 |

FOREIGN PATENT DOCUMENTS

| | | |
|---|---|---|
| DE | 9409707 | 10/1994 |
| DE | 20201236 | 10/2002 |
| DE | 20310251 | 11/2004 |
| WO | 94/14540 | 7/1994 |
| WO | 2007/010563 | 1/2007 |

* cited by examiner

*Primary Examiner* — Mark Rosenbaum
(74) *Attorney, Agent, or Firm* — Jacobson Holman, PLLC.

(57) ABSTRACT

The invention relates to a comb tooth holder, especially for comminution devices having cutting teeth disposed on comminution rolls, said cutting teeth interacting with comb teeth arranged on at least one mating holder or cage for comminuting the material to be comminuted. Said comb tooth holder consists of at least one comb tooth body and at least one comb tooth. The comb tooth can be fastened to the comb tooth body by means of a first positively locking portion, at least one additional positively locking portion being provided on the comb tooth holder for fastening the comb tooth to the comb tooth body. The invention is characterized in that a web surface connecting the two positively locking faces extends in the center of or centrally in the recess.

28 Claims, 2 Drawing Sheets

Figures 2A, 2B, 2C, 2D, 2E:
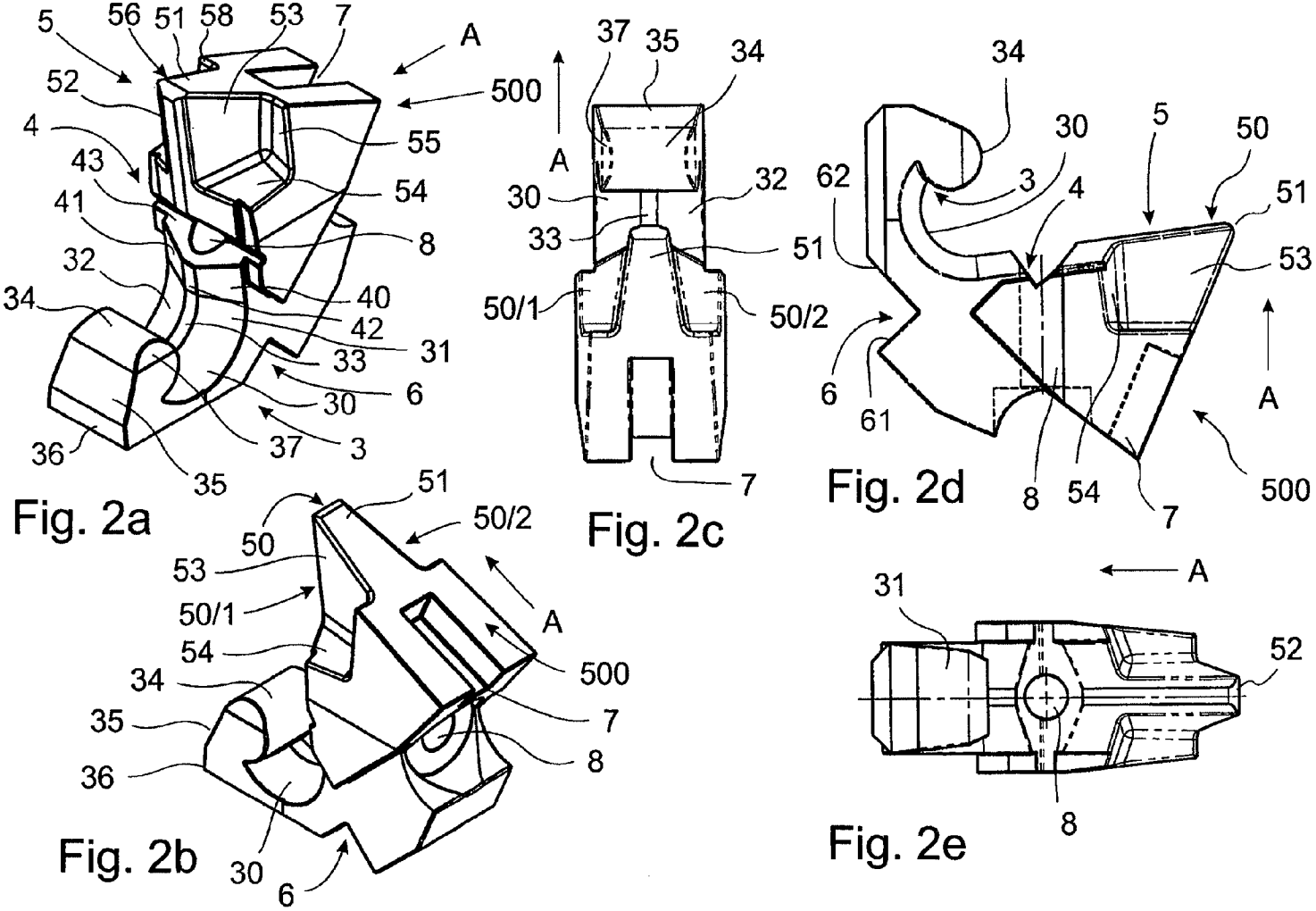

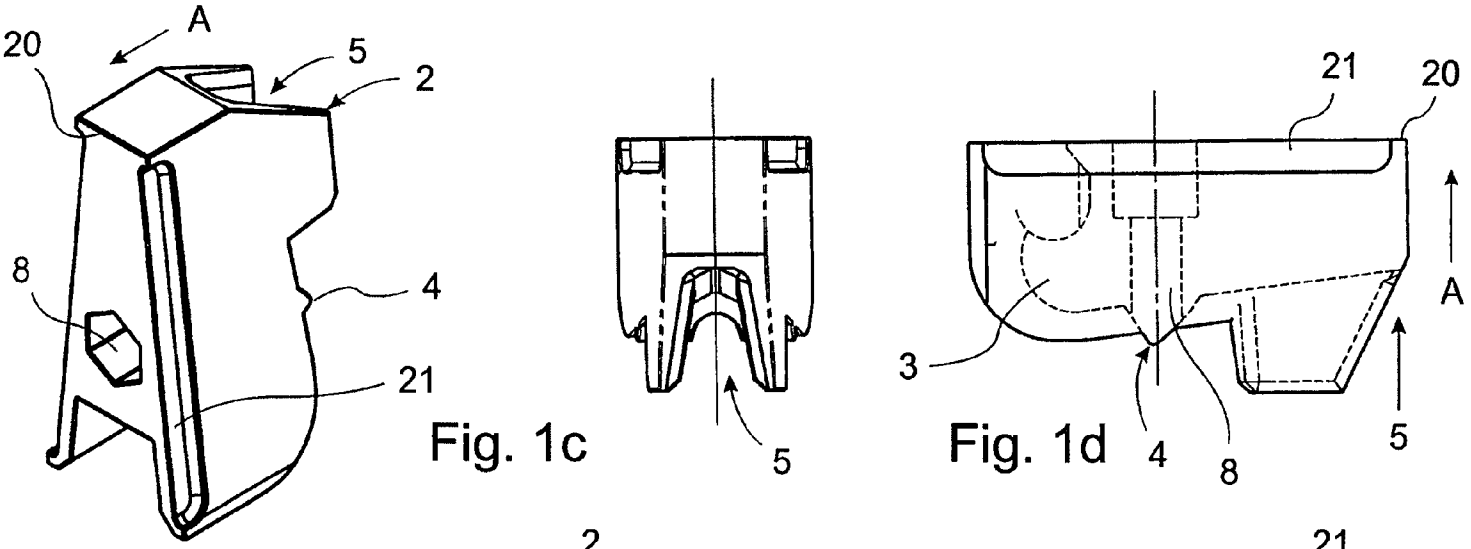
Fig. 1a
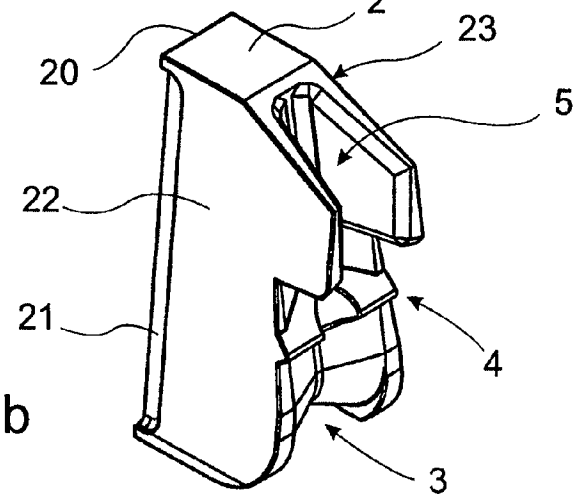
Fig. 1b
Fig. 1c
Fig. 1d
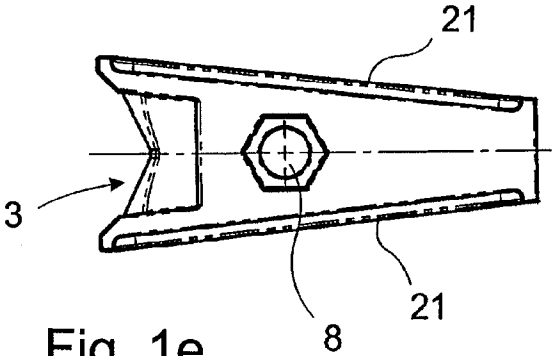
Fig. 1e

COMB TOOTH HOLDER

This is a national stage of PCT/EP11/002001 filed Apr. 20, 2011 and published in German, which has a priority of German no. 20 2010 006 078.8 filed Apr. 25, 2010, hereby incorporated by reference.

The invention refers to a comb tooth holder, in particular for comminution devices having cutting teeth disposed on comminution rolls interacting with comb teeth arranged on at least one mating holder or cage for comminuting the material to be comminuted, consisting of at least one comb tooth body and at least one comb tooth, wherein the comb tooth can be fastened to the comb tooth body by means of a first positively locking portion. The invention also refers to a comminution device or comminution machine with a comb tooth holder of this kind.

Comb tooth holders of this kind are known in the state of the art. They are employed in comminution devices or machines serving for very different comminution tasks. In particular, in the field of waste comminution plants these devices are used. Because of the different material to be comminuted, also the requirements concerning in particular the comminution tools, such as knives or teeth are different, so that often a change is required when other material has to be comminuted. The comminution tools are also prone to a high wear, so that also for this reason a frequent change is necessary. This goes in particular also for the teeth disposed on mating holders or cages of the comminution device. They interact with knives or teeth arranged on a comminution roll. They will be referred to in the following as comb teeth. The necessary change of the comb teeth because of wear or change of comminution material is very time-consuming, and thus causes large costs. The teeth provided as wear parts are rather expensive also because of the rather high portion of material.

In the prior application of the applicant DE 20 2005 009 859 U1, in the state of the art a knife body is known characterized by a positively locking arrangement of the knife at a knife or tooth body. This knife carrier is provided here for the arrangement on a comminution cylinder of the device. However, here also the material portion of the knife in the entire required material for knife and knife body is rather high.

Therefore, it is a problem of the invention to suggest a knife or comb tooth holder that allows a quick and simple change also of the comb teeth of a comminution device, and that reduces further the material portion of the tooth or knife in the entire required material.

The problem is solved by a comb tooth holder, in particular for comminution devices with cutting teeth disposed on comminution rolls, the cutting teeth interacting with comb teeth arranged on at least one mating holder or cage for comminuting the material to be comminuted, consisting of at least one comb tooth body and at least one comb tooth, wherein the comb tooth can be fastened to the comb tooth body by a first positively locking portion, that is characterized in that at the comb tooth holder at least one other positively locking portion is provided for fastening the comb tooth to the comb tooth body, and in the center or centrally in the recess, a web surface connecting the two positively locking surfaces extends.

When at least one other positively locking portion is provided between comb tooth and the comb tooth body, first, a required change is successfully made simpler and quicker. However, when another positively locking portion is provided, the material portion of the comb tooth is reduced compared with the entire required material. Thus also the cost portion of the comb tooth is less than with the devices known from the state of the art. The disadvantages of the state of the art are removed by this configuration. Additionally, now also the use of a tooth holder or knife carrier is possible at the so-called comb teeth or counter teeth of a comminution device, what has been solved so far in the state of the art in another way, in particular more expensively. The before-described comb tooth holders are furthermore characterized, according to the invention, in that in the center or centrally in the recess a web surface extends connecting the two positively locking surfaces. This also serves for further improving the positively locking portion and the already described advantageous effects connected with it. The first positively locking portion is here preferably, according to the invention, arranged at the end, in front in cutting direction, of the comb tooth body.

As described before, a comb tooth holder, according to an advantageous development, is characterized in that the comb tooth holder and the comb tooth have corresponding shape on the sides facing each other in assembly position for producing the positively locking portion/s. This is necessary for guaranteeing an exact attachment and, in particular, a low wear operation during the intended use. It also makes the change of the comb tooth considerably easier.

As described before, the comb tooth holder employs here as first positively locking portion, the positively locking portion known from DE 20 2005 009 859 U1 configured as recess that has, seen from the side, the shape of a "J". Therefore, in particular in the lower area of the comb tooth holder, the comb tooth can be inserted simply and securely and is, by this configuration, supported there suitably.

Furthermore, this before described comb tooth holder is also characterized in that the recess has wedge-like or conical, preferably configured ending at the outside, positively locking surfaces. They further improve the supporting and thus wear-reducing effects of the first positively locking portion.

In an embodiment, the comb tooth holder according to one of the before described embodiments or modifications is characterized in that in the end of the comb tooth body, seen in front in cutting direction, a nose is provided forming the front end of the recess and being configured preferably cylinder-like. In the interior of the comb tooth body, this generates the already described recess.

The invention suggests here furthermore that at the nose in cutting direction, a nose front face and a nose end are provided forming the front nose curve. This serves for reducing the wear at the front side of the comb tooth body.

Another aspect of the invention is the fact that at or in the comb tooth body a second positively locking portion is linked to the first positively locking portion. First of all, this improves self-centering of the comb tooth at the comb tooth body. Furthermore, thus the material portion of the comb tooth is reduced successfully as this second positively locking portion has a corresponding effect on the shape of the comb tooth.

According to the invention, the comb tooth holder as described before is characterized in that the second positively locking portion is provided as cross support for the comb tooth. In addition to the material reduction, this configuration effects a cross support and/or cross centering of the comb tooth at the comb tooth body. It can be seen in the drawing that this cross support serves also for material reduction of the comb tooth.

The principle of the surfaces supporting the comb tooth is also consequently realized in the second positively locking portion. Accordingly, the comb tooth holder is characterized, according to an embodiment of the invention, in that the second positively locking portion comprises a first and a second cross support surface that are, relatively to the positively locking surfaces, deflected, preferably deflected declining in cutting direction.

At the comb tooth holder, as described before, also at the second positively locking portion, a cross support surface web is provided connecting the two cross support surfaces.

Furthermore, the second positively locking portion is formed by at least one upper cross surface linked to the cross support surface web and the two cross support surfaces. This also improves the self-centering and supporting effect of the arrangement of the comb tooth at the comb tooth body.

Furthermore, the comb tooth holder according to the invention is characterized in that the upper cross surface is deflected in opposite direction, that is in opposite direction of the cutting direction, relatively to the cross support surface web and the two cross support surfaces. Also in this embodiment, the upper cross surface and the two cross support surfaces are configured wedge-like or conical, preferably ending at the outside.

A preferred modification of the comb tooth holder according to the invention provides that a part of the comb tooth body is configured a support body. According to the invention, at this support body the third positively locking portion is provided and formed, respectively. This particular configuration of the support body defines that the supporting qualities of the comb tooth body are further improved. The wear at the comb tooth body is reduced, and a quick change or exchange of the comb tooth is possible. Of course, this configuration serves in particular also for material reduction of the comb tooth.

A comb tooth holder according to one or more of the previously described embodiments is characterized in that the support body extends almost to a flight circle defined by the cutting edge of the comb tooth, or exterior radius of the comb tooth holder. The supporting effect is thus excellently supported further.

The invention suggests furthermore that the comb tooth engages in the support body of the comb tooth body. This serves also for realizing the third positively locking portion with the improvement of the support, self-centering and material reduction at the comb tooth.

Furthermore, it has been found according to the invention to be an advantage when the third positively locking portion is formed V-shaped, seen in opposite direction of the cutting direction, and ends at the outside while forming a recess. The recess/es is/are formed here preferably by at least one, in particular preferably two, receiving pockets. The seat and the receiving pockets, respectively, extend here in an advantageous development on the side of a center web.

The comb tooth holder according to the invention is here furthermore characterized in that a web front serves as front end of the recess. The receiving pockets are advantageously each time formed by a web side, a rest and a back support surface. The overall concept of the invention, that is low wear, supporting influence of the arrangement, rest and fastening, respectively, of the comb tooth in the comb tooth body, while, at the same time, the material portion is reduced, is here also realized consequently.

An advantageous modification of the comb tooth body, as described before, is also characterized here in that the support body has on its back end, seen in cutting direction, a slot separating the support body there. The material removal of the comminuted material is influenced positively by this.

The invention provides here that the comb tooth body can be arranged on, in particular fastened to, the mating holder or cage of the comminution device. Such a configuration has not yet become known in the state of the art in this way. It allows an economic arrangement, can be serviced easily for a comb tooth change, and serves additionally for the reduction of the material portion of the comb tooth.

A comb tooth holder according to one or more of the preceding embodiments is characterized in that at the underside or at the side facing the mating holder or cage, the comb tooth holder has a centering device for centering on the mating holder or cage. A fast and exact arrangement at or on the mating holder or cage is thus favored.

It has been found here to be convenient when the centering device of the comb tooth holder is configured as groove, in particular as cross groove or tongue interacting correspondingly and positively locking with a tongue or groove provided on the comminution roll. Furthermore, it is an advantage when the centering device has, seen from the side, the shape of a triangle, in particular a triangle with one tip pointing upwards.

A particular aspect of the invention suggests a comb tooth holder according to one or more of the previously described embodiments, modifications and developments, respectively, that is characterized in that at the comb tooth at the side facing the comb tooth body in assembling position at least two positively locking portions, preferably three positively locking portions are configured correspondingly with the shape of the previously described embodiments, modifications and examples, respectively. This is, of course, necessary to reach the before-described advantages compared with the state of the art. Accordingly, the configuration of the comb tooth body includes the configuration of the comb tooth in order to reach the comb tooth holder according to the invention.

According to the invention, it is furthermore provided that comb tooth body and comb tooth have fastening means by means of which they can be connected to each other detachably fixedly. The fastening means is, for example, at least one screw connection that is guided through bore holes in the comb tooth body and in the comb tooth.

The screw is guided through correspondingly arranged bore holes in comb tooth and comb tooth body, the nut being arranged at the en, in the back seen in the cutting direction, of the comb tooth body. It is protected there safely against wear or damage.

Furthermore, it is preferred when the comb tooth body and/or the comb tooth is produced of metal, preferably cast iron. This allows an economic production with relatively low costs.

In an advantageous development, the comb tooth holder is characterized in that the side faces of the comb tooth end diagonally upwards, taper or end at the exterior radius, and/or the comb tooth is designed narrower in the direction opposite the cutting direction than at the cutting edge. Thus, the comminution process is not impeded, and there are no unintended jammings that would require stopping the comminution process, in particular when the material is sticky or moist and adhesive.

The comb tooth holder according to the invention also provides that the positively locking portion/s is/are designed such that comb teeth having different exterior shapes, for example triangular, rectangular or polygonal comb teeth can be inserted or attached. The comb teeth are configured analogously here each time on the side facing the comb tooth body, that is correspondingly to it, and only the tooth shape on the cutting side differing to it depending on the respective tooth form. This increases considerably the universal function for a different use according to the purpose.

As already mentioned before, the positively locking portion/s is/are configured such that a self-centering is executed by the positively locking portion/s during fastening of the comb tooth at or on the comb tooth body.

It is an advantage here when the comb tooth at the side pointing towards the cutting edge has a concave deflection or curve, and/or is designed concavely. Furthermore, the comb tooth holder is characterized according to a development in that the comb tooth has a superimposed cutting edge as edge that is formed preferably of hard metal, preferably the size of the comb tooth being able to be adjusted because of different comminution tasks.

It is a particular advantage when the comb tooth is provided at the edges of the comb tooth pointing in cutting direction each time a chamfer, and/or has there at least one hardened area, wherein preferably the hardened area/s has/have been generated by hard facing or welding.

The invention also suggests a comminution device with at least one comb tooth holder according to one or more of the previously described embodiments or modifications. This comminution device is characterized by being extremely universal with respect to the material to be comminuted, a quick change of the cutting tools, and reduced material for the cutting tools, previously described as comb teeth.

A comminution device as described before is here characterized by a plurality of comb tooth holders disposed on the mating holder or cage. They interact with knives or teeth arranged on the comminution roll during the rotational movement of the comminution roll, the knives or teeth being arranged in spaces or staggered to the comb teeth.

However, the invention is not restricted to the arrangement of the comb tooth holder at the mating holder or cage. A configuration of the comminution device according to the invention is rather characterized by a plurality of comb tooth holders that are arranged on a comminution roll, in particular staggered to one another.

In the following, the invention will be described by means of an embodiment.

In the figures:

FIGS. 1*a* to 1*e* Different views of a comb tooth according to the invention, FIGS. 2*a* to 2*e* different views of a comb tooth body according to the invention.

In the figures, identical features each are described by identical reference numbers so that a new presentation is done without, if this is not necessary for understanding.

As the characteristics of the positively locking portions 3, 4, and 5 are shown in more detail at the comb tooth holder 1, the first to be described will be FIG. 2. The comb tooth holder 1 is shown in five different views. FIG. 2*a* shows here the comb tooth holder 1 in a three-dimensional representation transversely from the front, that is in opposite direction of the cutting direction A indicated by an arrow. FIG. 2*b* shows the comb tooth body 1 transversely from the back. FIGS. 2*c* to 2*e* show top view, side view and bottom view. A first positively locking portion 3 at the comb tooth body 1 is indicated schematically by an arrow. This is formed by a J-shaped recess 30. The front end is here formed by a nose 34 having a nose front face 35 as well as a nose end 36 at the side pointing in cutting direction A. The nose 34 has lateral flattenings 37. The recess 30 has a first positively locking surface 31 and a second positively locking surface 32 extending on both sides from a centrally arranged web surface 33. The first positively locking surface 31 and the second positively locking surface 32 are provided conically or declining deflected from the inside to the outside.

The second positively locking portion 4 is linked, seen in assembling position upwards, to the first positively locking portion 3, forms a cross support, and is also indicated schematically by an arrow at the reference number. The second positively locking portion 4 is formed, for example, by a first cross support surface 40, a second cross support surface 41, a cross support surface web 42 that are deflected in the direction of the cutting direction A relatively to the first positively locking portion 3. The two cross support surfaces 40 and 41 are also again provided deflected or conically declining outwards. Part of the second positively locking portion is furthermore the upper cross surface 43, that is then deflected in opposite direction to the cutting direction. This effects another support and centering of the comb tooth 2 at the comb tooth body 1. The material reduction at the comb tooth 2 (see FIG. 1) is a result of the fact that the second positively locking portion 4 extends in the body of the comb tooth 2 in a centering opening that is provided there correspondingly and not described in detail. In the area of the upper cross section 43 a bore hole 8 is provided receiving a not-shown screw for connecting comb tooth body 1 and comb tooth 2.

On top in assembly position, a support body 500 is provided at the comb tooth body 1. At this support body 500, the third positively locking portion 5 is provided that is again indicated by an arrow at the reference number. The third positively locking portion 5 is formed by a V-shaped provided seat 50. This is formed by the receiving pockets 50/1 and 50/2 extending on the side of a center web 51. The front end of the seat 50 is formed by a web front 52. The receiving pockets 50/1 and 50/2 are again formed by a web side 53, 56, rests 54, 57, and back support surfaces 55, 58 each. The recess, necessary by the center web 51 in the comb tooth 2, leads to material reduction at the comb tooth 2. The embodiment shown in the figures is altogether also suited for reducing the wear at the comb tooth body, and, in particular, for improving the fastening and the exchange of the comb tooth 2. The self-centering effects of such a design are excellent. Seen in cutting direction, at the comb tooth body 1 a slot 7 is provided. This also serves for saving material (here at the comb tooth body 1), and in particular for an improved material removal after the comminution process. In FIGS. 2*a* and 2*b* a centering device 6 can be seen very clearly, that has, seen from the side, the shape of a triangle with a tip pointing upwards. This serves for centering the comb tooth body 1 at the mating holder or cage of the comminution device.

FIGS. 1 a to 1 e show the comb tooth 2 belonging to the comb tooth holder in different views—three-dimensional presentation transversely from the front and from the back, as well as top view, side view and bottom view. The characteristics of the positively locking portions 3, 4 and 5 are each time a result, analogously to the embodiment described in comb tooth body 1, by a corresponding shaping. The comb tooth 2 has a cutting edge 20. At the side of the comb tooth 2 facing in cutting direction A, a concavely configured deflection or curve is provided. At the side edges of the comb tooth 2 facing in cutting direction A, chamfers 21 are designed that have either hardened areas or that form an additional cutting edge and/or reinforcement of the comb tooth 2 by hard facing or welding. The comb tooth 2 tapers from the bottom to the top at its side surfaces 22 and 23. As it can be seen in particular also in FIG. 1*e*, such a tapering of the entire comb tooth 2 is also provided in opposite direction of the cutting direction A.

The figures are only intended for a better understanding of the already in the description presented way of function. Therefore, the already described functions and effects are not repeated again here.

The invention has been described before by means of an embodiment by several figures. The claims filed now and along with the application later on are attempts for formulating without prejudice for obtaining a broader protection.

References in the depending claims refer to the further configuration of the subject matter of the main claim by the characteristics of the respective sub-claim. However, they are not to be understood as a waiver for obtaining an independent, subjective protection for the characteristics of the referred sub-claims.

Characteristics only disclosed in the description so far can be claimed, in the course of proceedings, as being of inventive relevance, for example to distinguish from the state of the art.

The invention claimed is:

1. A comb tooth assembly for comminution devices having cutting teeth disposed on comminution rolls interacting with comb teeth arranged on at least one mating assembly or cage for comminuting the material to be comminuted, consisting of at least one comb tooth body and at least one comb tooth, wherein the comb tooth is fastened to the comb tooth body by means of a first positively locking portion, the locking portion have two positively locking surfaces, wherein at the comb tooth body a second positively locking portion is provided for fastening the comb tooth to the comb tooth body, wherein at or in the comb tooth body the second positively locking portion is connected to the first positively locking portion and a web surface connecting the two positively locking surfaces extends in the center or centrally in a recess, wherein the second positively locking portion comprises at least one upper cross surface and the upper cross surface is angled relatively to a cross support surface web and two cross support surfaces are provided in opposite direction, that is in opposite direction of cutting and/or the upper cross surface and the two cross support surfaces are configured a wedge shape or a conical shape.

2. The comb tooth assembly according to claim 1, wherein the comb tooth body and the comb tooth have on the sides facing one another in assembling position a corresponding shape for producing the positively locking portions.

3. The comb tooth assembly according to claim 1, wherein the first positively locking portion is configured as recess and the recess has a wedge shape or conical positively locking surfaces configured ending at the outside.

4. The comb tooth assembly according to claim 3, wherein the first positively locking portion is arranged at the end of the comb tooth body that is in front in the direction of cutting.

5. The comb tooth assembly according to claim 1, wherein at the end of the comb tooth body, a nose is provided forming the front end of a recess of the first positively locking portion, and at the nose in the direction of cutting a nose front face and a nose end are provided forming a front curve of the nose.

6. The comb tooth assembly according to claim 1, wherein the second positively locking portion is provided as cross support for the comb tooth.

7. The comb tooth assembly according to claim 1, wherein angled declining in the direction of cutting and/or the second positively locking portion has a cross support surface web connecting the two cross support surfaces to one another, the second positively locking portion is furthermore formed by at least one upper cross surface connected to the cross support surface web and the two cross support surfaces.

8. The comb tooth assembly according to claim 1, wherein a part of the comb tooth body is designed as support body.

9. The comb tooth assembly according to claim 8, wherein the support body extends almost to a flight circle defined by a cutting edge of the comb tooth.

10. The comb tooth assembly according to claim 1, wherein the comb tooth engages in a support body of the comb tooth body.

11. The comb tooth assembly according to claim 1, wherein a third positively locking portion is provided and configured, respectively, at a support body as part of the comb tooth body.

12. The comb tooth assembly according to claim 11, wherein the third positively locking portion ends towards the outside, seen in opposite direction of the cutting direction, V-shaped, forming a seat and/or the seat is formed by at least one seat pockets.

13. The comb tooth assembly according to claim 1, wherein a seat of the comb tooth body is provided and the seat and seat pockets, respectively, extend on the side of the center web, a web front serves as front end of the seat.

14. The comb tooth assembly according to claim 13, wherein seat pockets as part of the seat are provided, each are formed by a web side, a rest and a back support surface and/or a support body is provided and the support body has at its back end, seen in the direction of cutting, a slot separating the support body.

15. The comb tooth assembly according to claim 1, wherein the comb tooth assembly is arranged on a mating assembly or cage of the comminution device and/or the comb tooth assembly has on its underside of its side facing the mating assembly or cage, a centering device for centering on the mating assembly or cage, the centering device of the comb tooth assembly is configured as groove interacting correspondingly and positively locking with a tongue or groove provided on the comminution roll.

16. The comb tooth assembly according to claim 1, wherein a centering device is provided on the comb tooth assembly and the centering device, seen from the side, has the shape of a triangle.

17. The comb tooth assembly according to claim 16, wherein a tip of a triangle points upwards or at the comb tooth at the side pointing at the comb tooth body in the position of assembling.

18. The comb tooth assembly according to claim 1, wherein comb tooth body and comb tooth have fastening means by means of which they can be connected to one another detachably fixedly, and/or the fastening means is determined by at least one screw connection that is guided through bore holes in the comb tooth body and the comb tooth.

19. The comb tooth assembly according to claim 18, wherein the comb tooth body or the comb tooth is made of metal.

20. The comb tooth assembly according to claim 1, wherein side surfaces of the comb tooth are provided and the side surfaces of the comb tooth end diagonally upwards, taper or end at the outer radius, and/or the comb tooth is configured in opposite direction of the cutting direction narrower than at the cutting edge and/or on the side pointing in the cutting direction towards the cutting edge, the comb tooth has a concave deflection or rounding, and/or is configured concavely.

21. The comb tooth assembly according to claim 1, wherein the positively locking portions are designed such that comb teeth with differing shapes, can be inserted or fastened and/or the positively locking portions are configured such that a self-centering is performed by the positively locking portions when the comb tooth is fastened.

22. The comb tooth assembly according to claim 21, wherein the comb teeth has a triangular, rectangular or polygonal shape.

23. The comb tooth assembly according to claim 1, wherein the comb tooth has a superimposed cutting edge and/or the size of the comb tooth can be adapted because of different comminution tasks and/or the comb tooth at the edges pointing in the direction of cutting each time a chamfer is provided, and/or has there at least one hardened area, and/or the hardened area/s has/have been created by hard facing or welding.

24. The comb tooth assembly according to claim 23, wherein the edge is made of hard metal.

25. The tooth assembly according to claim 1, wherein the first positively locking portion is configured as recess having a J-shape when seen from the side.

26. A comminution device with at least one comb tooth holder for comminution devices having cutting teeth disposed on comminution rolls interacting with comb teeth arranged on at least one mating holder or cage for comminuting the material to be comminuted, consisting of at least one comb tooth body and at least one comb tooth, wherein the comb tooth can be fastened to the comb tooth body by means of a first positively locking portion, the locking portion have two positively locking surfaces, wherein at the comb tooth holder a second positively locking portion is provided for fastening the comb tooth to the comb tooth body, wherein at or in the comb tooth body the second positively locking portion is connected to the first positively locking portion and a web surface connecting the two positively locking surfaces extends in the center or centrally in a recess, wherein the second positively locking portion comprises at least one upper cross surface and the upper cross surface is angled relatively to the cross support surface web and two cross support surfaces are provided in opposite direction, that is in opposite direction of cutting and/or the upper cross surface and the two cross support surfaces are configured a wedge shape or a conical shape.

27. The comminution device according to claim 26, wherein a plurality of comb tooth holders arranged on the mating holder or cage.

28. The comminution device according to claim 26, wherein a plurality of comb tooth holders arranged on a comminution roll staggered to one another.

* * * * *